US006385828B1

(12) United States Patent
Kiss et al.

(10) Patent No.: US 6,385,828 B1
(45) Date of Patent: May 14, 2002

(54) APPARATUS AND METHOD FOR SPLITTING A TOW OF FIBERS

(75) Inventors: Peter A. Kiss, Chesterfield; Jeffrey M. Deaton, St. Louis; Michael S. Parsons, Chesterfield; Donald Coffey, St. Louis, all of MO (US)

(73) Assignee: Zoltek Companies, Inc., St. Louis, MO (US)

( * ) Notice: Subject to any disclaimer, the term of this patent is extended or adjusted under 35 U.S.C. 154(b) by 0 days.

(21) Appl. No.: 09/939,633

(22) Filed: Aug. 28, 2001

(51) Int. Cl.[7] ..... D02J 1/18
(52) U.S. Cl. ..... 28/282; 19/65 T
(58) Field of Search ..... 28/282, 283, 220; 19/65 T

(56) References Cited

U.S. PATENT DOCUMENTS

| | | | | |
|---|---|---|---|---|
| 2,801,455 A | | 8/1957 | McLellan | |
| 3,032,829 A | | 5/1962 | Mahoney et al. | |
| 3,376,609 A | | 4/1968 | Kalwaites | |
| 3,380,131 A | | 4/1968 | Gray | |
| 3,698,039 A | | 10/1972 | Kalwaites | |
| 3,708,832 A | * | 1/1973 | Lohrke | 28/282 |
| RE27,727 E | | 8/1973 | Kim et al. | |
| 3,840,941 A | | 10/1974 | Neveu | |
| 3,865,565 A | | 2/1975 | Spence et al. | |
| 4,179,776 A | * | 12/1979 | Wortman | 28/282 |
| 4,301,579 A | * | 11/1981 | Van den Hoven | 28/282 |
| 5,042,122 A | * | 8/1991 | Iyer et al. | 28/283 |
| 5,094,883 A | | 3/1992 | Muzzy et al. | |
| 5,214,828 A | * | 6/1993 | Neuert et al. | 28/282 |
| 5,355,567 A | | 10/1994 | Holliday | |
| 6,168,747 B1 | | 1/2001 | Reese et al. | |

* cited by examiner

*Primary Examiner*—Danny Worrell
(74) *Attorney, Agent, or Firm*—Morrison & Foerster LLP

(57) ABSTRACT

An apparatus for splitting a fiber tow, the apparatus having a spreading bar comprising a crown and a circular or oval-shaped splitter bar comprising grooves around the circumference of the splitter bar, wherein each of the grooves does not circumscribe the complete circumference of the splitter bar, and a method therefor are disclosed.

24 Claims, 11 Drawing Sheets

Figure 2d

| ITEM | QTY | DESCRIPTION |
|---|---|---|
| 1 | 1 | FRAME WELDMENT |
| 2 | 1 | SIZING PUMP PNEUMATIC ASSEMBLY |
| 3 | 8 | SHAFT MOUNT – McMASTER–CARR No. 6068K29 |
| 4 | 16 | BOLT – ø3/8"–16 UNC x 1" LG. |
| 5 | 16 | LOCKWASHER – ø3/8" |
| 6 | 6 | PILLOW BLOCK – SEALMASTER No. VP–32R |
| 7 | 12 | BOLT – ø5/8"–11 UNC x 2" LG. |
| 8 | 12 | LOCKWASHER – ø5/8" |
| 9 | 1 | OFFSET SPLITTER PLATE |
| 10 | 8 | BOLT – ø3/8"–16 UNC x 1" LG. |
| 11 | 8 | LOCKWASHER – ø3/8" |
| 12 | 2 | OFFSET SPLITTER ROLL |
| 13 | 2 | OFFSET SPLITTER ROLL INDEXING ARM |
| 14 | 4 | BOLT – ø3/8"–16 UNC x 1" LG. |
| 15 | 4 | LOCKWASHER – ø3/8" |
| 16 | 2 | INDEX PLUNGER – CARR–LANE No. CL–8–LHRP |
| 17 | 1 | JAM NUT – 1/2"–13 UNC |
| 18 | | |
| 19 | 2 | ø2" FLAT BAR |
| 20 | 1 | ø2" GROOVED BAR |
| 21 | 1 | ø2" SPREADER BAR |
| 22 | 1 | I/R HEATER ASSEMBLY |
| 23 | 6 | BOLT – ø1/2"–13 UNC x 1–1/2" LG. |
| 24 | 6 | LOCKWASHER – ø1/2" |
| 25 | 1 | SIZING SYSTEM ASSEMBLY |
| 26 | 4 | BOLT – ø1/2"–13 UNC x 1–1/2" LG. |
| 27 | 4 | LOCKWASHER – ø1/2" |
| 28 | 4 | SOC. HD. CAP SCREW – #10–24 UNC x 1–1/2" LG. |
| 29 | 4 | LOCKWASHER – #10 |
| 30 | 1 | SIZING DIP ROLLER |
| 31 | 4 | BOLT – ø3/8"–16 UNC x 1–1/2" LG. |
| 32 | 4 | LOCKWASHER – ø3/8" |
| 33 | 2 | ENCLOSURE – TELEMECANIQUE No. XAP–G19501 |
| 34 | 4 | SELF–TAPPING SCREW – #10–24; McMASTER–CARR No. 90087A247 |
| 35 | 2 | PUSH BUTTON – SQUARE D No. ZB2BT4 |
| 36 | 2 | HEAD GUARD – SQUARE D No. ZB2BZ1801 |
| 37 | 2 | MOUNTING BASE – SQUARE D No. ZB2BZ104 |

APPARATUS AND METHOD FOR SPLITTING A TOW OF FIBERS

TECHNICAL FIELD

This invention relates to an apparatus and method for splitting a tow of fibers. The invention has particular applicability in splitting a large tow having more than 12,000 carbon fibers.

BACKGROUND ART

The requirement for high production rates of carbon fibers is that the fibers should be produced in large tows containing several thousand filaments, e.g., 48,000 (48K, where "K" means 1,000). On the other hand, there are several applications that require the use of a thin tow having, for example, 6,000 filaments. In such applications, one should use a thin tow that is either manufactured as a thin tow or has been split into a thin tow from a large tow. However, it is extremely difficult to split a large tow, particularly of carbon fiber, into several thin tows because of problems such as fuzz formation and tow-to-tow variability of the thin tows.

Prior to this invention, various methods have been tried to spread and split large carbon fiber tows as they emanate from a carbon fiber production line. The primary problems are fiber crossovers between the small tows, fiber breakage, and creation of fiber fuzz, all of which make additional processing into useful products difficult.

Therefore, there exists a need for technology enabling the splitting of a large tow into several thin tows without fuzz formation and deterioration of the fibers.

SUMMARY OF THE INVENTION

During the course of the present invention, it was unexpectedly found that a combination of smooth grooved guide and splitter bars having crown radii and groove depths could provide a mechanical means for splitting a large carbon fiber tow (up to 320K or higher) into multiple smaller tows without fiber disorientation, fiber breakage, or creation of fiber fuzz.

This invention produces the following advantages. First, the large tow is uniformly spread without fiber crossover by passing over one or more crowned roller bars. Second, the spread tow is cleanly split using two or more eccentric splitter guide bars. Third, no air or other means of contacting or handling of the fibers is required. Fourth, the split strands are clean and contain almost no protruding fuzz or microfibers.

The apparatus and method of this invention can be used to subdivide or equally split a large tow of carbon fibers. It may be incorporated into the carbon fiber production processing line as a portion of the sizing section of the line. Or, it may be set up as a separate off-line entity to split already produced carbon fiber tows. There are a variety of reasons for reducing the tow size, one of which is to subsequently chop the smaller tows to produce a sheet-molding compound (SMC). Alternatively, the smaller tows may be individually sized with different materials as they pass through different sections of the sizing bath.

One embodiment of this invention is an apparatus for splitting a fiber tow, comprising a spreading bar comprising a crown and a circular or oval-shaped splitter bar comprising grooves around the circumference of the splitter bar, wherein each of the grooves do not circumscribe the complete circumference of the splitter bar.

Another embodiment is a method for splitting a fiber tow, comprising passing the fiber tow over a spreading bar which has a crown and passing the fiber tow over a circular or oval-shaped splitter bar comprising grooves around the circumference of the splitter bar, wherein each of the grooves do not circumscribe the complete circumference of the splitter bar.

In one embodiment, the radius of the crown (R) on the spreading bar is uniquely related to the width of the spread of the tow and/or the width of the crown (W) of a spreading bar. See FIG. 3. The ranges of the ratio R/W are about 50/1 to 3/1, preferably between 25/1 to 4/1, more preferably between 12/1 to 5/1, and most preferably about 7/1.

In another variation, the splitter bar is alternately grooved and smooth around the circumference of the bar and has precisely shaped grooves of proper depth (D) and proper center-to-center spacing (C) of the grooves on its surface. The ranges of the ratio C/D are about 50/1 to 3/1, preferably between 40/1 to 4/1, more preferably between 25/1 to 5/1, and most preferably about 16/1.

Additional advantages and other features of the present invention will be set forth in part in the description that follows and in part will become apparent to those having ordinary skill in the art upon examination of the following or may be learned from the practice of the present invention. The advantages of the present invention may be realized and obtained as particularly pointed out in the appended claims. As will be realized, the present invention is capable of other and different embodiments, and its several details are capable of modifications in various obvious respects, all without departing from the present invention. The drawings and description are to be regarded as illustrative in nature, and not as restrictive.

BRIEF DESCRIPTION OF DRAWINGS

FIG. 2*d* shows the numeral references used in FIGS. 2*a*, 2*b* and 2*c*.

DESCRIPTION OF THE INVENTION

The present invention enables the manufacture of thin tows from a large tow by splitting the large tow in a predetermined manner.

The tow splitter of this invention was developed to manufacture a split strand for the automotive industry to develop a carbon fiber product that is similar to fiberglass roving in spool form. The carbon fiber available to the inventors was packaged in a spool form with a filament count of 48K (actual count ~45,700). The bundle of the 48K tow fiber was much larger than a fiberglass roving and did not portray the desired characteristics of randomness when chopped and sprayed to form a random fiber sheet. The inventors, therefore, developed an apparatus and process for the separation of 7–10 individual strands (also referred to as "thin tows") within the 48K fiber tow. These strands, when chopped and sprayed, produced a random pattern of the strands over a desired area. A random fiber composite made from the random strands produced mechanical properties, particularly modulus, superior to those of another random fiber composite using the 48K fiber tow directly by the same chopping and spraying method as that used for making the random fiber composite from the random strands.

By combining various designs of grooves and crown surfaces, applicants unexpectedly found that by a proper combination of grooves and crown surfaces one could accomplish effective splitting of a large 48K carbon fiber tow into several individual strands. Six different arrangements of bar geometry, groove depth and width, and crown radii have been tried at line speeds up to 40 feet per minute. Using a pilot unit, a 48K tow has successfully been cleanly split into as many as 10 essentially equal smaller tows at line speeds typical of commercial fiber production.

Briefly, a 48K tow is split into 7–10 strands, which go through a sizing bath, drying ovens and are then wound back onto spools. Various concentrations of several sizing agents have been used to obtain fiber sizing contents of 1.5%, 2.5% or 6.5%. Any water dispersible sizing agent may be used depending on the end use resin of choice. Previous experimentation indicates that the sizing content needs to be about 2.5% to prevent excessive fuzz from being produced at the chopper.

The properties of the split strands that are critical for composite applications are the following: (1) Reduction in fly when chopping (as measured by wash-off test). (2) Separation of split strands (which are also referred to as strands and thin tows) while unspooling (i.e., minimizing bird nesting, tows sticking together). (3) Cost. (4) Composite modulus. (5) Split strand mass variation. (6) Split strand length variation (package weight).

Figure 1:
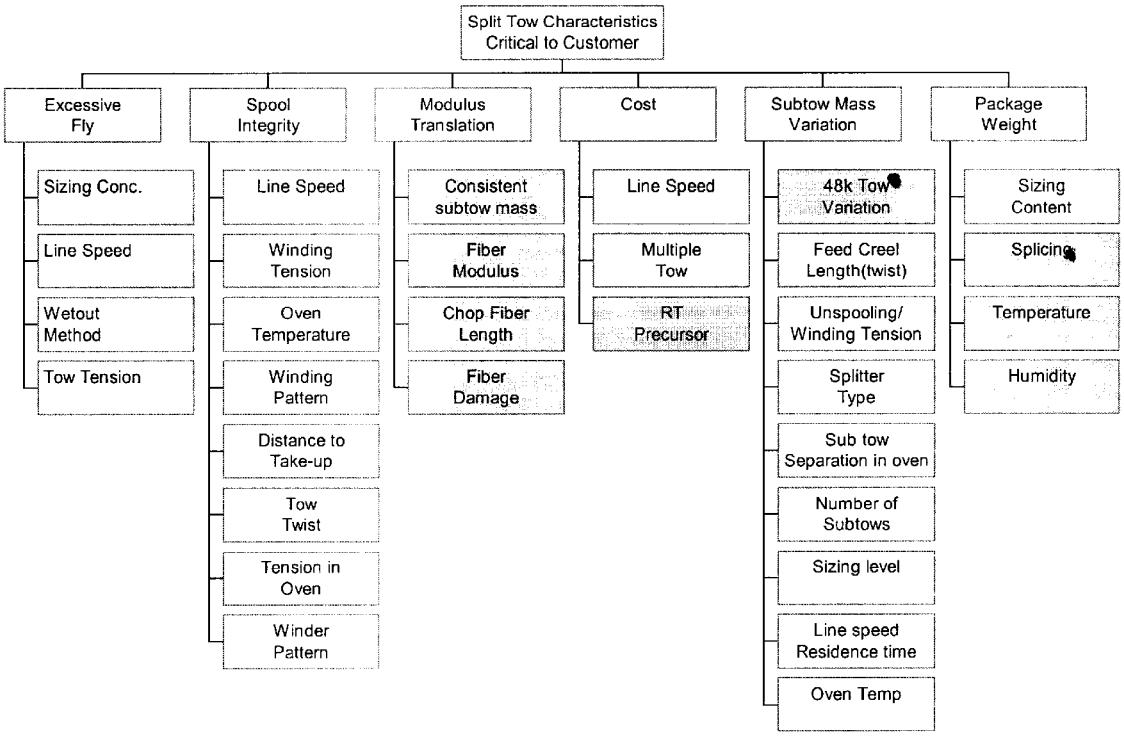
FIG. 1 schematically shows a fishbone type chart identifying some of the variables considered to affect the quality of the split strand of this invention.

Throughout the development of the apparatus and process of this invention, the applicants strived to identify the variables that affect the quality of the split strand because prior to this invention one did not even know what variables affect the quality of the split strand and the extent to which each variable would affect the quality of the split strand. A fishbone type chart is shown in FIG. 1 identifying some of the variables that could affect the quality of the split strand. Applicants did not vary the items in the shaded boxes.

The factors important for designing the apparatus and method of this invention are the following:

(1) Feed and Creel comprising (a) back tension on spool unwinding and (b) tow path to splitting area.

(2) Tow splitting and sizing equipment comprising (a) splitting apparatus; (b) location of splitting apparatus; (c) spreading device; (d) residence time in wet-out tank (tank size); and (e) sizing concentration (wet-out path).

(3) Drying Ovens comprising (a) means for controlling temperature; (b) means for controlling residence time of the fiber in the oven; (c) means for measuring the winding tension; (d) means for measuring the tow width; and (e) means for measuring split strand separation.

(4) Winder comprising (a) means for setting a winding pattern; (b) winding equipment and (c) means for measuring the winding tension.

Explained below are some preferred features of different aspects (listed below numerically) of the apparatus and method of this invention.

(1) Feed and Creel: Applicants found that a twist in the thick feedstock tow causes problems in splitting of the large tow. However, the large tow used in the examples of this invention had twists. However, a long despooling distance was found to prepare the large tow for splitting. Unspooling from the outside was found to avoid excessive twist. Breaker bars helped in spreading out the width of the large tow. It was found that a dry tow was easier to spread than a wet tow containing the same number of filaments.

(2) Tow Splitting and Sizing: The solid content in the sizing bath was adjusted to about 2.7% to achieve a target sizing content of about 2.5% on the split strand. Fogging nozzles were used to pre-wet the fiber prior to splitting to reduce fuzz buildup. In one embodiment, a coiled wire was used to split the tow and adjust the split strand mass. All bars contacting the fibers were chrome plated to avoid excessive fuzz buildup. The bar immediately following the splitter bar, leading into the bath, should be static (fixed and not rotating) due to the tendency of the fiber to wrap around a rotating bar. The bar located after the sizing bath should be dynamic (e.g., vibrating) to help alleviate fuzz buildup and lower tension.

(3) Drying Ovens: There should be minimal contact points, if any, throughout the remaining process until the split strands get to the nip roller. Therefore, finger guides were used before the first drying oven to keep the split strands apart in the drying oven. Preferably, the separation between split strands should be greater than 1" to ensure adequate drying of the split strands without allowing the split strands to contact each other. Finger guides were not used between the first and last ovens. Finger guides were used for the split strand at the exit of the last oven to ensure that the split strands stay apart from one another. Bundling fibers together here would lead to some split strands sticking to one another. To avoid this, one could use one or more of the following: (a) a longer distance between the exit of the oven and the winder, (b) some method of cooling, or (c) slower line speed. The ambient temperature is also a factor that determines whether split strands would remain separated. The preferred ambient temperature and humidity are 90° F. and 30% RH.

(4) Winding: The winding pattern used in the examples of this invention was a 3.5-wind pattern, but other patterns would also work with the apparatus and method of this invention. The tension on the winder was 1300 g. It was found that a package could be wound looser, resulting in a package that does not become intertwined (reducing tendency for bird nesting). All fuzz was picked off of split strands before winding to prevent fuzz from entering the spool and resulting in bird nesting. All spools were doffed when a split strand breaks. It was observed that split strand breaks get intertwined in the spool and result in despooling problems.

Test Methods:

(1) Degree of Separation: A test method was developed to quantify the degree of separation of the split strands in each spool. The split strands were chopped into approximately 2" lengths and sprayed to check if the split strands separate and randomly distribute in the composite after being chopped. The test method called for approximately 10 yards of material to be stripped from both the inside and outside of the spool prior to testing. This ensured that the split strand had not been previously handled. Next, the split strand was cut. The tows were held three feet off a surface before cutting into 2–3" lengths and dropping them under gravity from this height to the smooth metallic surface. A total of 5 feet of a split strand was chopped and dropped onto the surface to produce about 120 chopped strands. These chopped split strands landed on the surface and were counted. If all of the chopped split strands were sticking together, the degree of separation was zero. If none of the chopped split strands were sticking together, the degree of separation was 1. The fraction of the chopped split strands not sticking together was considered to be the degree of separation. This testing method was a good gauge to determine the degree of separation of the split strands.

In addition to testing for split strand separation, a visual inspection is made to detect winding irregularities, and moisture and sizing contents are measured. This data is collected for every feed spool of material run through the process.

The typical properties of the feedstock used in the examples of this invention were the following: (1) Filament density (g/cc)=1.82±0.03; (2) Tensile Strength (Ksi)=525 or more; (3) Tensile Modulus (Msi)=32 or more; (4) Elongation (%)=1.4% or more; (5) Resistivity (ohm·cm×$10^{-3}$)=1.5±0.2; (6) Tow mass (g/m)=3.4±0.2.

The desired properties of the split strand made by the apparatus and process of this invention were the following: (1) Split strand number=7–10; (2) Filaments per split strand and split tow mass=5–8K and 0.6–0.35 g/m; (3) Sizing content (wt %)=2.5±0.5%; (4) Moisture content 0 to 0.15%; (5) Package type=Center-core pull with label on outside; (6) Spool weight >10 pounds; and (7) Despoolability=no weld tows, i.e., tows stuck together, or bird nests, i.e., fuzz pile-ups.

The tow splitting apparatus and the method of splitting a large tow into split strands are described below.

In order to achieve the roving like format of split strands while maintaining an attractive price, it was found desirable to produce the 7–10 "sub-tows," i.e., split strands, from a larger tow of about 48K rather than using a more expensive 3K, 6K or 12K product. This equipment was designed to make split strands on a production scale with minimal operator contact. The apparatus of this invention allows for spreading and splitting multiple tows in a small area without using air to puff up the large tow. It is also unique in the ability to handle imperfections in the tow due to twisting and knots or splices when starting new spools.

The split strand apparatus comprises five components. They are:

(1) Feed Creel(s)

(2) Splitter Station (3) Dryer (4) Take-up (5) Winder & Packaging

Preferably, the split strand process would use all five pieces of equipment to make the finished product. However, other components could be provided as required. The most preferred component is the splitter station, which is further described below.

Figure 2A:
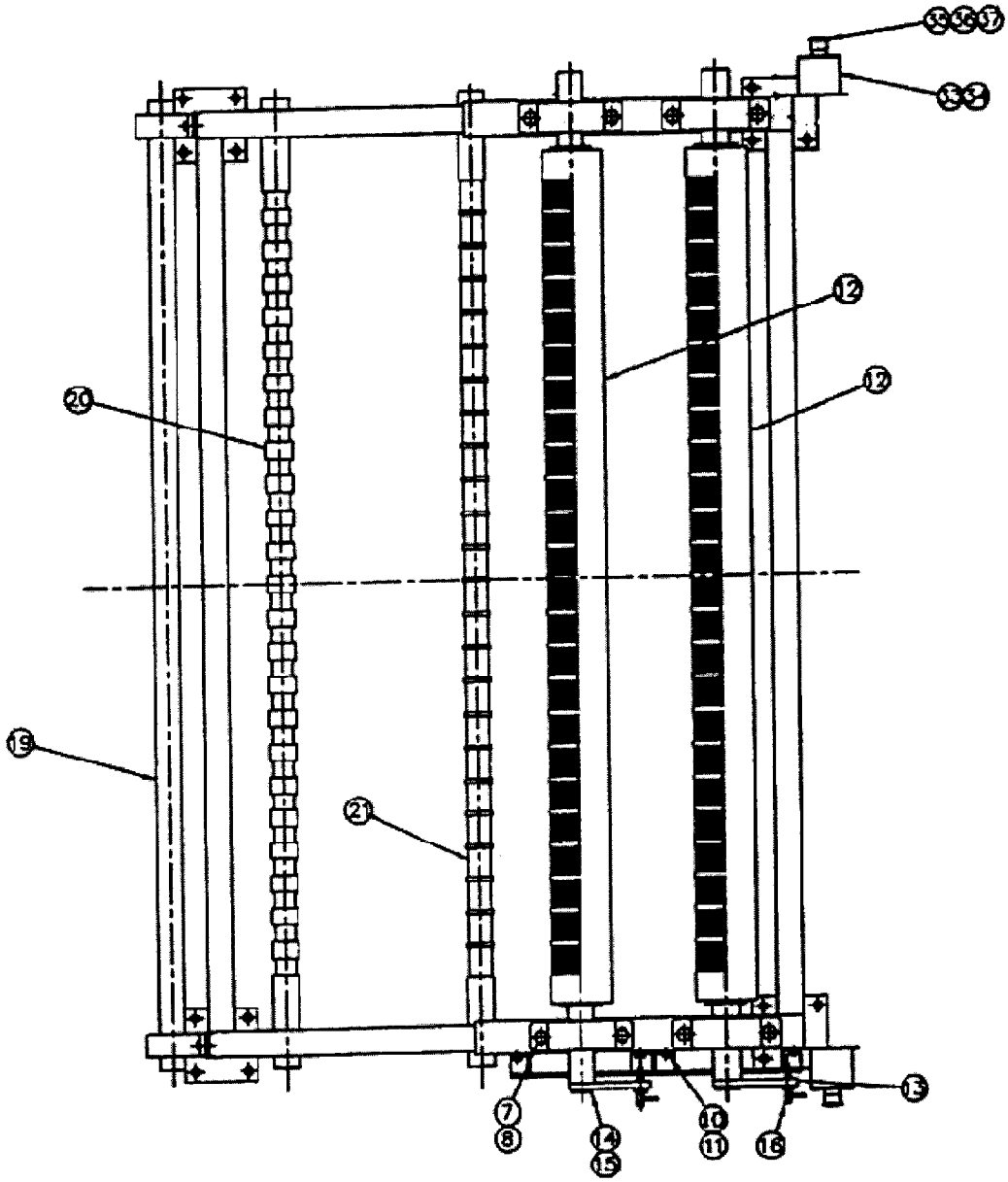
FIGS. 2*a*, 2*b* and 2*c* show a plan view and the side views of an embodiment of the splitter station.
Figure 2B:
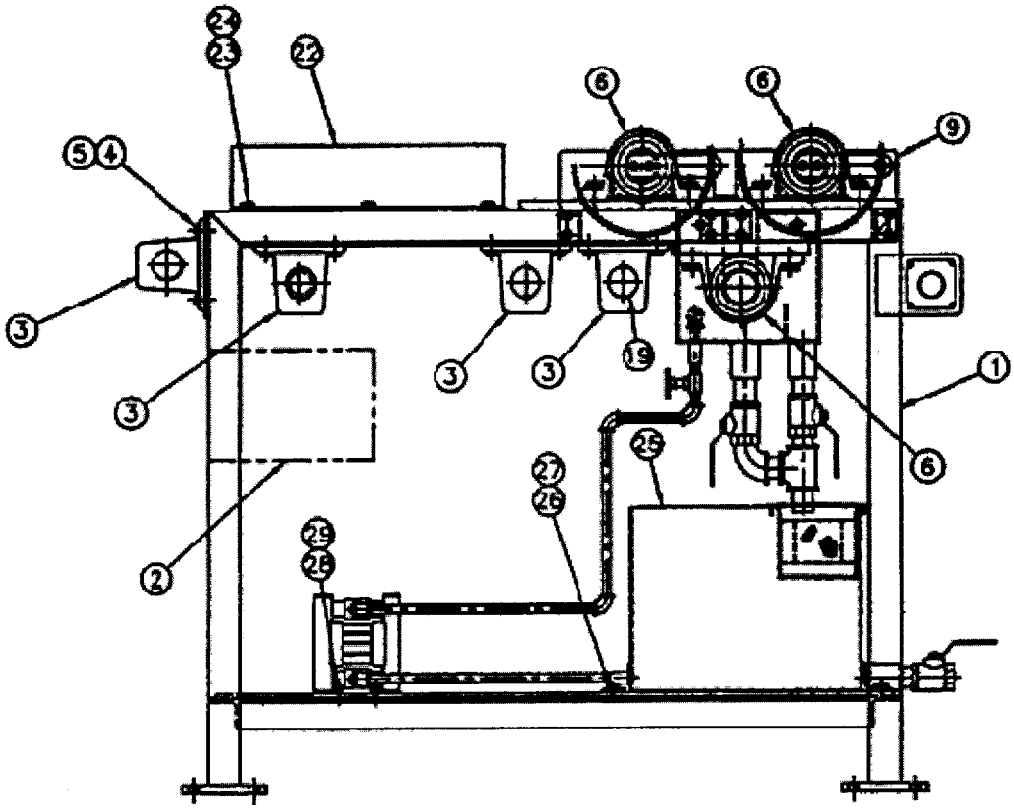
Figure 2C:
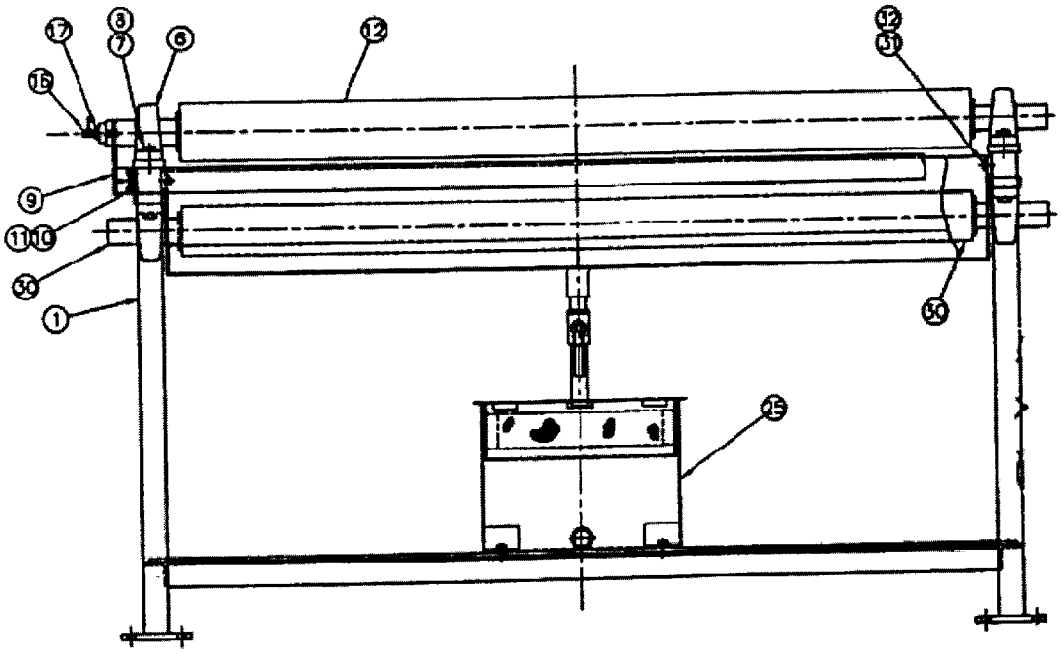
Figure 2E:
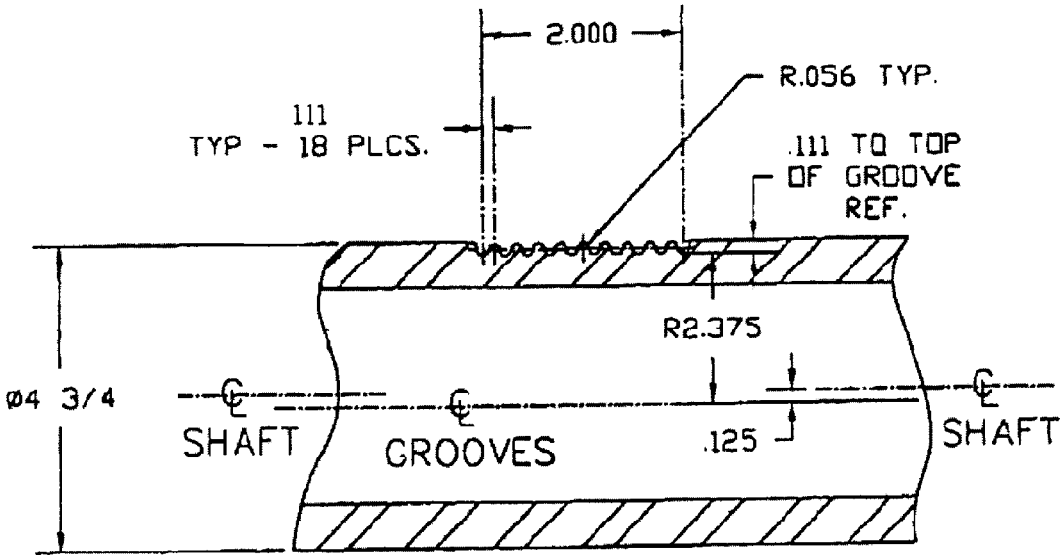
FIG. 2*e* shows the detail of the groove geometry on the splitting rollers.

A plan view and the side views of the splitter station are shown in FIGS. 2*a*, 2*b* and 2*c*. The numeral references used in FIGS. 2*a*, 2*b* and 2*c* are shown in FIG. 2*d*. The splitter station has eight components of which spreader roller 21 and splitter bar 12 are most important for the purposes of this invention. The eight components from left to right, which is the direction in which a large tow moves through the splitter station of FIG. 2, are the following:

(1) Ø2" First flat bar 19 shown in FIG. 2*a* is for guiding the tow from the feed creel into the splitter station, where "Ø" means diameter and the double apostrophe mean inch.

(2) Ø2" Grooved guide bar 20 shown in FIG. 2*a* is for guiding the large tow to the spreader bar 21.

Figure 3:
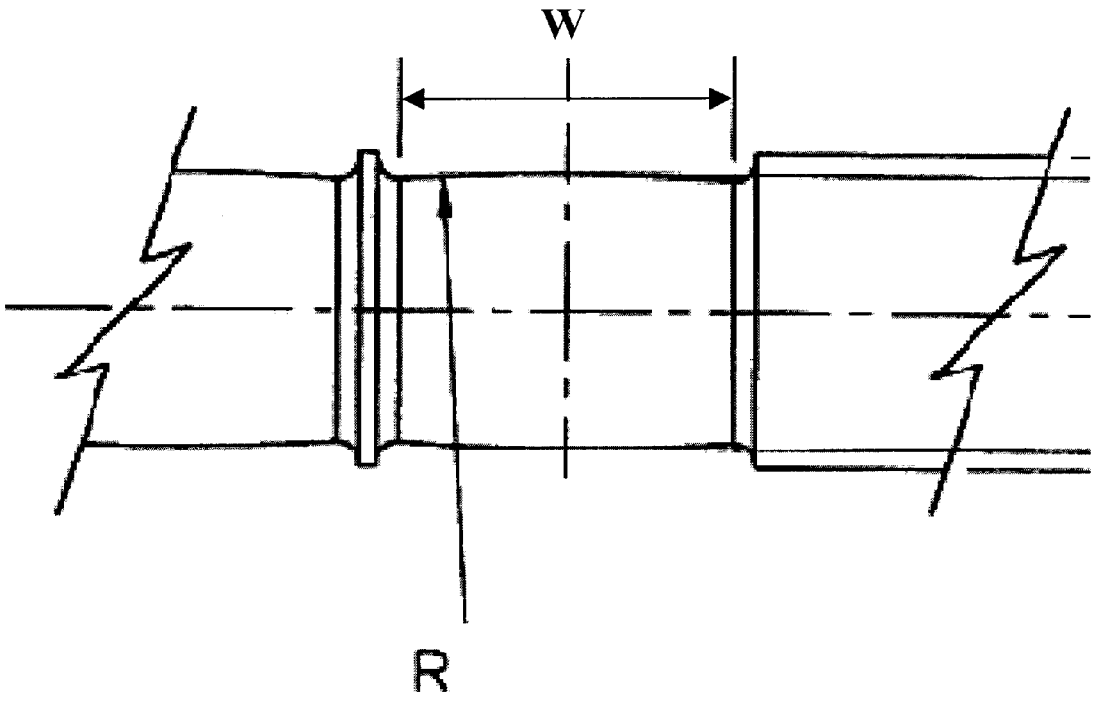
FIG. 3 shows a crown portion of a splitter bar.

(3) Ø2" Spreader bar 21 shown in FIG. 2*a* is for spreading a 48 K tow to 2⅛" width. The spreader bar 21, a portion of which is shown enlarged in FIG. 3, has a crown radius (R) which varies from about 5" to 40", preferably between about 10" to 25", most preferably 15".

(4) Infrared Heater 22 shown in FIG. 2*b* is for removing moisture from the large tow. It also aids in spreading the large tow.

(5) Ø2" Second flat bar 19 shown in FIG. 2*b* is for maintaining the width of the tow over the radius of the spreader bar. The second flat bar 19 is the same as the first flat bar 19.

(6) Ø4¾" First offset splitter bar 12 ("splitter") shown in FIG. 2*a* is a circular or oval roller with grooves machined on half the circumference. The grooves have a 1/16" radius at the top and bottom with a micro-finish of 16. The first offset splitter bar splits the large tow into multiple split strands.

(7) Sizing system 25 having Ø4" sizing dip roller 30 in FIG. 2*c* is for the application of a sizing agent on the split strands. The sizing dip roller 30 is partially submerged in a sizing bath tray. The split strand is guided under the sizing dip roller 30 for pick-up of the sizing agent. This is required for strand integrity of the finished product.

(8) Ø4¾" Second offset splitter bar 12 ("split strand guide") shown in FIG. 1*a* is substantially identical to the first offset splitter bar 12. The second offset splitter bar 12 helps guide and further separate the split strands as they exit the sizing bath and enter an infrared heater (not shown in FIGS. 2*a* and 2*b*).

Spreading is accomplished by four Ø2" spreader bars, which are stationary and are mounted with shaft mounts to the frame. The friction generated over these bars along with the infrared heater allows the 48K carbon fiber tow to spread to 2⅛" wide. The spreading portion is dependent upon four friction bars and an infrared heater. The most important feature of the spreader bar is a crown with a radius of about 15". This geometry along with the distance and tension between the other friction bars and heat are necessary to achieve a tow width of 2⅛".

Splitting is done by two Ø4¾" rollers that are mounted on pillow block bearings and remain stationary during spreading and splitting. In order to keep the rollers stationary, an indexing plate is used to allow 180° of rotation. A handle with an indexing plunger 13 is mounted to the journal of the roller and is used to lock the roller in place. The splitting portion of the process is dependent upon two stationary rollers with grooves machined on half the circumference. The grooves are ⅛" deep with a radius of 1/16" at the top and bottom (see FIG. 2*e*, which shows one embodiment of the grooved roller). This geometry is functional for spreading as well as splitting. The desired number of splits (7–10) are dependent upon the degree of spread achieved through the friction bars.

Sizing is done by Ø4" idler roller that is mounted to the frame with pillow block bearings. It is partially submerged in the sizing bath tray. This tray is part of a circulation system that maintains the desired concentration of sizing to be applied to the tow while it is split. The amount of sizing pick-up on the split strand will determine the characteristic of the end product. It will determine the stiffness, drapability and fall-out of the splits when chopped. The surface finish and cleanliness of the product is determined as well. The sizing process is dependent upon the splitting and spreading of the tow for the degree of pick-up and the quality of the product. The sizing, when dried, will also maintain the split integrity within the 48K bundle and thus prevent the splits from blending together again.

There are three ways to use the splitter station.

Start-up Procedure (New Spool on Splitter Station)

1. Guide end of tow by hand from feed creel exit to Ø2" flat bar 19. Place over the top of the bar. Be sure that tow is flat with no twists.

2. Guide tow under groove of Ø2" groove bar 20. Be sure that tow is flat with no twists. Be sure that IR heater 22 is off.
3. Guide tow over radius of Ø2" spreader bar 21. Be sure that tow is flat with no twists.
4. Guide tow under Ø2" flat bar 19. Be sure that tow is flat with no twists.
5. Guide tow over smooth portion of Ø4¾" offset splitter roll 12 set in the 0° position (grooves for tow path to the right). Be sure that tow is flat with no twists.
6. Guide tow under Ø4" sizing dip roll 30 while wearing surgical gloves. Be sure that tow is flat with no twists. Check sizing system. Sizing level in tray must cover bottom of roll to ensure good pick-up on the tow.
7. Guide tow over smooth portion of Ø4¾" offset splitter roll 12 set in the 0° position (grooves for tow path to the right). Be sure that tow is flat with no twists. Guide end to entrance of dryer and tie off to lifeline or guide through rest of system.
8. Turn IR heater 22 on at splitter station and wait for the unit to reach a required temperature.
9. When heater is ready, start nip unit at take-up.
10. Watch the tow at the splitter station and wait until it is spread over the width of the spreader bar 21.
11. When the desired width of the tow is met at the first offset splitter roll 12, rotate the roll so that the grooves are centered on the 180° position. Lock into place.
12. Watch the splits form and work their way under the sizing dip roll 30 and over the second offset splitter roll 12. Rotate this roll so that the grooves are centered on the 180° position. Lock into place. The splits should be synchronized with the first roll. These splits are dried further down the system and guided to the winders to be packaged in a spool form again.

Re-split Procedure (Twist on Splitter Station)

If a full or half-twist has formed, here is the procedure to handle this.

1. Locate area of twist in process. If the twist has worked its way up to the first Ø4¾" offset splitter roll 12 and you are maintaining only seven splits, it is time to re-split.
2. Rotate the first Ø4¾" offset splitter roll 12 set in the 0° position (grooves for tow path to the right), so that tow is on the smooth side. Be sure that the groove run-out on either side is not inhibiting the spread. Lock into place.
3. Watch the twist work its way over the first Ø4¾" offset splitter roll 12 and under the sizing dip roller 30.
4. Rotate the second Ø4¾" offset splitter roll 12 set in the 0° position (grooves for tow path to the right), so that tow is on the smooth side. Be sure that the groove run-out on either side is not inhibiting the spread. Lock into place. The twist will then work its way through the rest of the system.
5. Repeat start-up procedures #10–12.

Re-split Procedure (Knot or splice on Splitter Station for new spool)

When starting a new spool from the feed creel or when encountering a broken end before the splitter station, follow this procedure.

1. Locate knot or splice in process. Rotate the first and second Ø4¾" offset splitter rolls 12 before the knot or splice reaches them so that the tow is on the smooth side (0° position is the grooves for tow path to the right). Watch the knot go over both rolls and wait for the tow to spread. Be sure that the groove run-out on either side is not inhibiting the spread. Lock into place.
2. Repeat start-up procedures #10–12.

EXAMPLES

Figure 4:
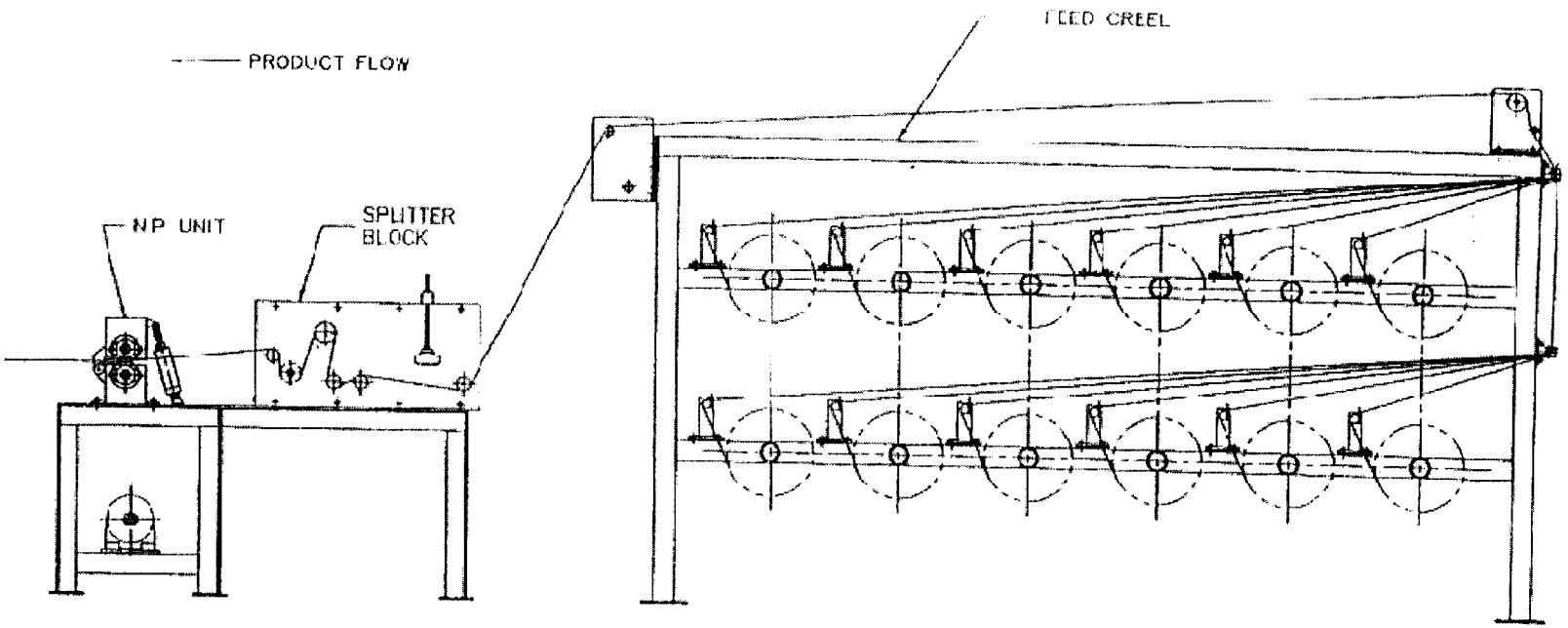
FIG. 4 shows an experimental setup for a tow spreader and splitter.
Figure 5:
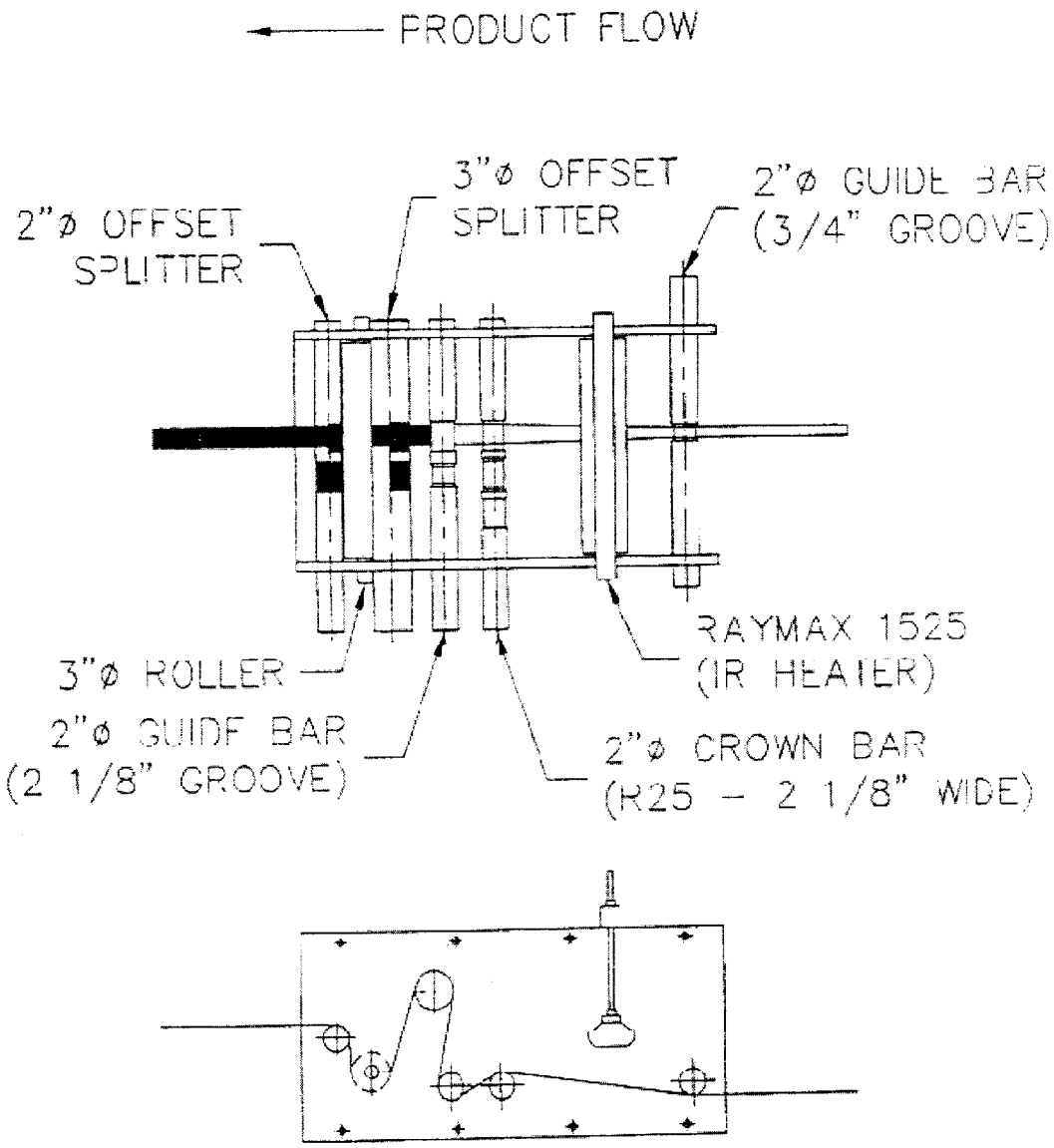
FIG. 5 shows a first embodiment of a tow spreader.

The experiments were set up on a tow sheet spreader with one spool taken up from a feed creel as shown in FIG. 4. All experiments were done at line speeds of 5–60 feet per minute (fpm). The splitter block design on the tow spreader was setup in the following arrangements:

Example 1 as Exemplified in FIG. 5

Example 1 was carried out under the following conditions:

2"Ø Grooved Guide Bar (¾" wide groove)

Raymax 1525 IR Heater (3" above tow)

2"Ø Crown Bar (R=25", i.e., R25, and 2⅛" wide)

2"Ø Grooved Guide Bar (2⅛" wide groove)

3"Ø Offset Splitter Bar (2" wide centers, ⅛" deep grooves)

3"Ø Roller (Submerged sizing roller)

2"Ø Offset Splitter Guide Bar (2" wide centers, ⅛" deep grooves)

The spreading test of Example 1 was done with and without grooves and the results are shown in Table 1a (with grooves) and Table 1b (without grooves) below.

TABLE 1a

| Speed (fpm) | Spread (width) | # of Splits | Time (min.) | Comments |
|---|---|---|---|---|
| 5 | 1½" (No splits) | 7 | 10 | Even Splits; Splitter Bar - Vertical |
| 10 | 1½" (No splits) | 7 | 5 | Even Splits; Splitter Bar - Vertical |
| 18 | 1⅝" (No splits) | 7 | 5 | Even Splits; Splitter Bar - Vertical |
| 36 | 1⅝" (No splits) | 7 | 10 | Even Splits; Splitter Bar - Vertical |
| 60 | 1⅝" (No splits) | 7 | 5 | Even Splits; Splitter Bar - Vertical |

TABLE 1b

| Speed (fpm) | Spread (width) | # of Splits | Time (min.) | Comments |
|---|---|---|---|---|
| 5 | 1½" (No splits) | 7 | 10 | Even Splits; Splitter Bar - Vertical |
| 10 | 1½" (No splits) | 7 | 5 | Even Splits; Splitter Bar - Vertical |
| 18 | 1½" (No splits) | 7 | 5 | Even Splits; Splitter Bar - Vertical |
| 36 | 1½" (No splits) | 7 | 5 | Even Splits; Splitter Bar - Vertical |
| 60 | 1½" (No splits) | 7 | 5 | Even Splits; Splitter Bar - Vertical |

Figure 6:
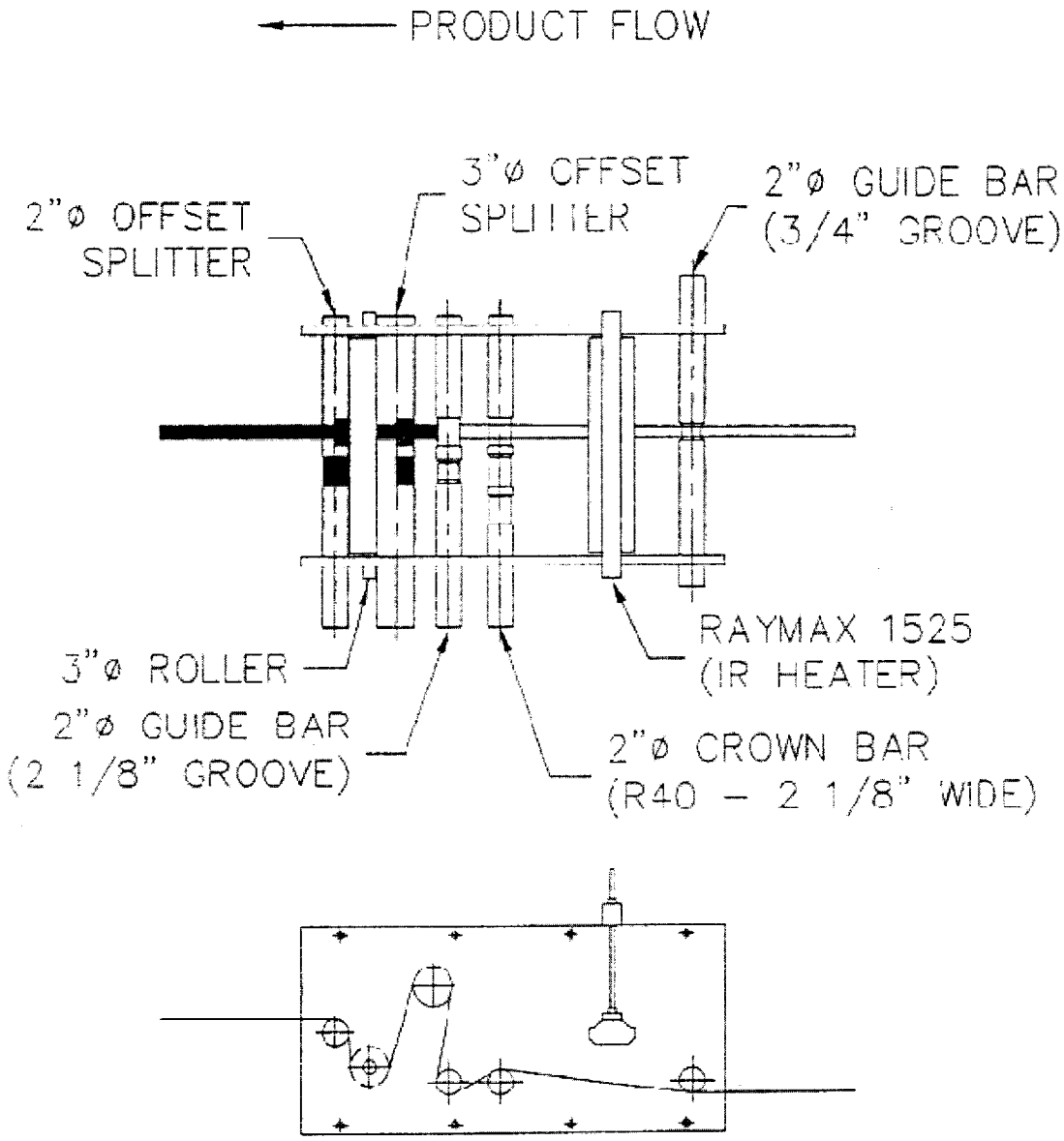
FIG. 6 shows a second embodiment of a tow spreader.

Example 2 as Exemplified in FIG. 6

Example 2 was carried out under the following conditions:

2"Ø Grooved Guide Bar (¾" wide groove) Raymax 1525 IR Heater (3" above tow)

2"Ø Crown Bar (R=40", i.e., R40, and 2⅛" wide)

2"Ø Grooved Guide Bar (2⅛" wide groove)

3"Ø Offset Splitter Bar (2" wide centers, ⅛" deep grooves)

3"Ø Roller (Submerged sizing roller)

2"Ø Offset Splitter Guide Bar (2" wide centers, ⅛" deep grooves)

The spreading test of Example 2 was done with and without grooves and the are shown in Table 2a (with grooves) and Table 2b (without grooves) below.

TABLE 2a

| Speed (fpm) | Spread (width) | # of Splits | Time (min.) | Comments |
|---|---|---|---|---|
| 5 | 1⅛" (No splits) | 5 | 5 | Even Splits; Splitter Bar - Vertical |
| 10 | 1⅛" (No splits) | 5 | 5 | Even Splits; Splitter Bar - Vertical |
| 18 | 1⅛" (No splits) | 5 | 5 | Even Splits; Splitter Bar - Vertical |
| 36 | 1⅛" (No splits) | 5 | 5 | Even Splits; Splitter Bar - Vertical |
| 60 | 1⅛" (No splits) | 5 | 5 | Even Splits; Splitter Bar - Vertical |

TABLE 2b

| Speed (fpm) | Spread (width) | # of Splits | Time (min.) | Comments |
|---|---|---|---|---|
| 5 | 1⅛" (No splits) | 5 | 5 | Even Splits; Splitter Bar - Vertical |
| 10 | 1⅛" (No splits) | 5 | 5 | Even Splits; Splitter Bar - Vertical |
| 18 | 1⅛" (No splits) | 5 | 5 | Even Splits; Splitter Bar - Vertical |
| 36 | 1¼" (No splits) | 6 | 5 | Even Splits; Splitter Bar - Vertical |
| 60 | 1¼" (No splits) | 6 | 5 | Even Splits; Splitter Bar - Vertical |

Figure 7:
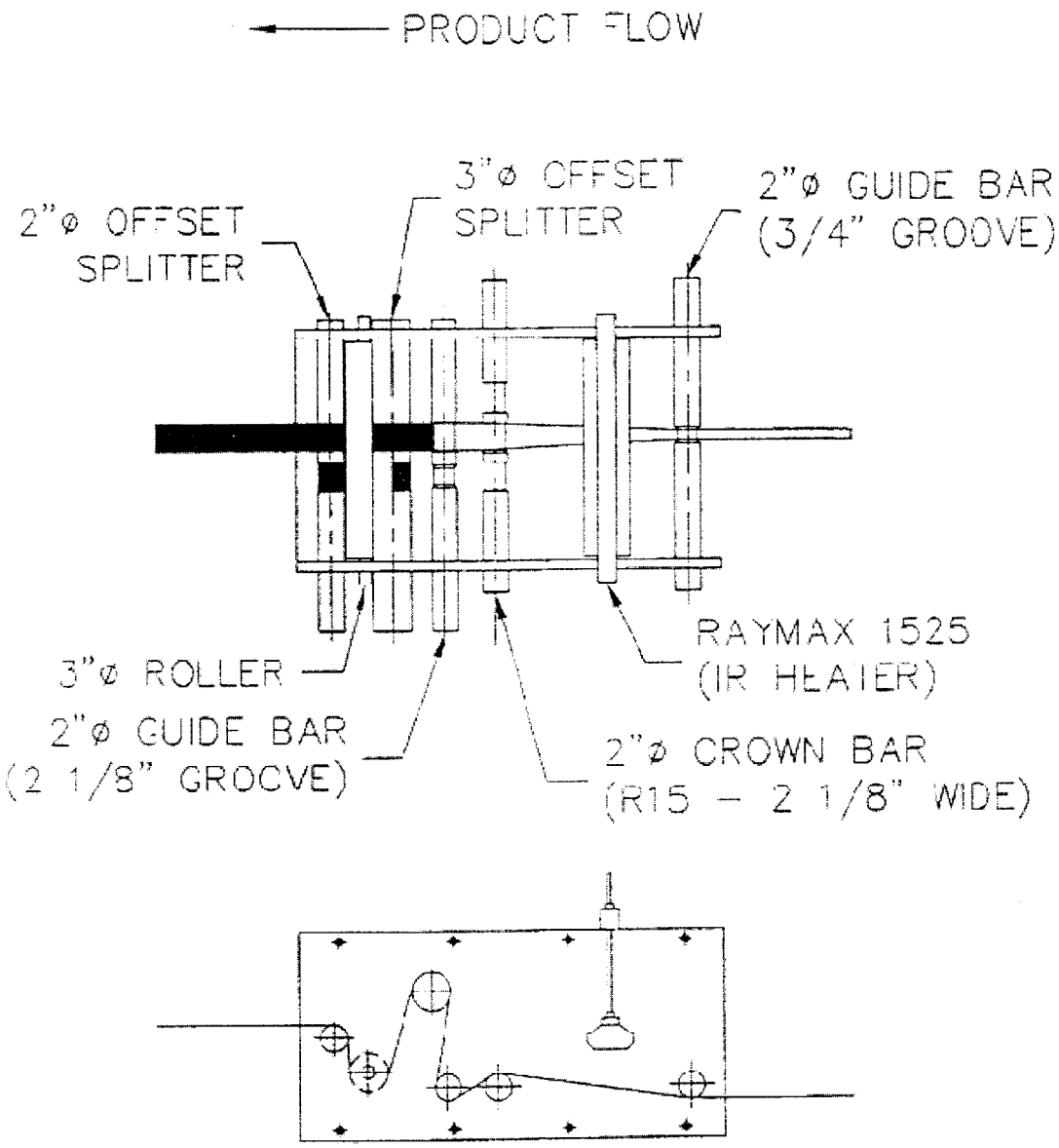
FIG. 7 shows a third embodiment of a tow spreader.

Example 3 as Exemplified in FIG. 7

Example 3 was carried out under the following conditions:

2"Ø Grooved Guide Bar (¾" wide groove)

Raymax 1525 IR Heater (3" above tow)

2"Ø Crown Bar (R=15", i.e., R15, and 2 ⅛" wide)

2"Ø Grooved Guide Bar (2⅛" wide groove)

3"Ø Offset Splitter Bar (2" wide centers, ⅛" deep grooves)

3"Ø Roller (Submerged sizing roller)

2"Ø Offset Splitter Guide Bar (2" wide centers, ⅛" deep grooves)

The spreading test of Example 3 was done with and without grooves, and the are shown in Table 3a (with grooves) and Table 3b (without grooves) below.

TABLE 3a

| Speed (fpm) | Spread (width) | # of Splits | Time (min.) | Comments |
|---|---|---|---|---|
| 5 | 1¾–2" (1–3 splits) | 8–10 | 5 | Even Splits; Splitter Bar - Vertical |
| 10 | 1¾–2" (1–3 splits) | 8–10 | 5 | Even Splits; Splitter Bar - Vertical |
| 18 | 1¾–2" (1–3 splits) | 8–10 | 5 | Even Splits; Splitter Bar - Vertical |

TABLE 3a-continued

| Speed (fpm) | Spread (width) | # of Splits | Time (min.) | Comments |
|---|---|---|---|---|
| 36 | 1¾–2" (1–3 splits) | 8–10 | 5 | Even Splits; Splitter Bar - Vertical |
| 60 | 1¾–2" (1–3 splits) | 8–10 | 5 | Even Splits; Splitter Bar - Vertical |

TABLE 3b

| Speed (fpm) | Spread (width) | # of Splits | Time (min.) | Comments |
|---|---|---|---|---|
| 5 | 2" (1–3 splits) | 10 | 5 | Even Splits; Splitter Bar - Vertical |
| 10 | 2" (1–3 splits) | 10 | 5 | Even Splits; Splitter Bar - Vertical |
| 18 | 2" (1–3 splits) | 10 | 5 | Even Splits; Splitter Bar - Vertical |
| 36 | 2" (1–3 splits) | 10 | 5 | Even Splits; Splitter Bar - Vertical |
| 60 | 1¾–2" (1–3 splits) | 8–10 | 5 | Even Splits; Splitter Bar - Vertical |

The goal of the above experiments was to produce 7–10 splits in a repeatable fashion from 48K tow. It was found that a crown radius of R=25" consistently produced 7 splits, but this is the minimum requirement. A crown radius of R=40" did very little for spreading and thus yielded 5 splits. A crown radius of R=15" produced the best splitting geometry that approached the desired 2" width and produced 8–10 splits. Although 1–3 minor splits developed in the spread, this did not affect the splitting process.

The 2⅛" grooved bar (after the crown bar) did nothing to improve the spread. In some cases, it inhibited it. A flat bar would prove more reliable and would be cheaper as well.

Both offset splitter bars performed very well. When the spread of the tow reached the maximum width, the 3"Ø splitter bar was rotated 180° clockwise (CW). As the splits progressed through the sizing roller, the splits are easily aligned with the grooves: on the 2"Ø splitter bar. This bar was rotated 180° CW as well. The finished split tow was clean with very few micro-fibers clinging between each split. Over-sized fiber should eliminate this.

Based on the results from these examples, Example 3 with a 2"Ø flat bar after the crown bar produced the best results.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of the invention. Thus, this invention is not intended to be limited to the embodiments shown, but is to be accorded the widest scope consistent with the principles and features disclosed herein.

This application discloses several numerical range limitations. Persons skilled in the art would recognize that the numerical ranges disclosed inherently support any range within the disclosed numerical ranges even though a precise range limitation is not stated verbatim in the specification because this invention can be practiced throughout the disclosed numerical ranges. A holding to the contrary would "let form triumph over substance" and allow the written description requirement to eviscerate claims that might be narrowed during prosecution simply because the applicants broadly disclose in this application but then might narrow their claims during prosecution. Finally, the entire disclosure of the patents and publications referred in this application are hereby incorporated herein by reference.

What is claimed is:

1. An apparatus for splitting a fiber tow, comprising:

a spreading bar comprising a crown and a circular or oval-shaped splitter bar comprising grooves around the circumference of the splitter bar, wherein each of the grooves does not circumscribe the complete circumference of the splitter bar.

2. The apparatus of claim 1, further comprising:

a feed and creel device, a drying oven and a winder.

3. An apparatus for splitting a fiber tow, comprising:

a spreading bar comprising a crown and a circular or oval-shaped splitter bar comprising grooves around the circumference of the splitter bar, wherein each of the grooves do not circumscribe the complete circumference of the splitter bar and wherein a radius of the crown is R, a width of the crown is W and a ratio R/W is about 50/1 to 3/1.

4. The apparatus of claim 3, further comprising:

a feed and creel device, a drying oven and a winder.

5. The apparatus of claim 3, wherein the grooves have a depth D, a center to center spacing C and a ratio C/D is about 50/1 to 3/1.

6. The apparatus of claim 3, wherein said ratio R/W is about 7/1.

7. The apparatus of claim 3, wherein the fiber tow is selected from the group consisting of organic fibers and inorganic fibers.

8. The apparatus of claim 7, wherein the organic fibers are selected from the group consisting of polymeric fibers and natural fibers.

9. The apparatus of claim 7, wherein the inorganic fibers are selected from the group consisting of glass fibers, carbon fibers, silicon fibers, silicon nitride fibers, alumina fibers, metallic fibers, steel tungsten fibers and boron fibers.

10. The apparatus of claim 3, wherein the fiber tow comprises carbon fibers.

11. A method for splitting a fiber tow, comprising:

passing the fiber tow over a spreading bar comprising a crown, passing the fiber tow over a circular or oval-shaped splitter bar comprising grooves around the circumference of the splitter bar, wherein each of the grooves do not circumscribe the complete circumference of the splitter bar.

12. The method of claim 11, further comprising:

passing the fiber tow through a feed and creel device, passing the fiber tow through a drying oven and passing the fiber tow through a winder.

13. A method for splitting a fiber tow, comprising:

passing the fiber tow over a spreading bar comprising a crown and passing the fiber tow over a circular or oval-shaped splitter bar comprising grooves around the circumference of the splitter bar, wherein each of the grooves do not circumscribe the complete circumference of the splitter bar and wherein a radius of the crown is R, a width of the crown is W and a ratio R/W is about 50/1 to 3/1.

14. The method of claim 13, further comprising:

passing the fiber tow through a feed and creel device, passing the fiber tow through a drying oven and passing the fiber tow through a winder.

15. The method of claim 13, wherein the grooves have a depth D, a center to center spacing C and a ratio C/D is about 50/1 to 3/1.

16. The method of claim 13, wherein said ratio R/W is about 7/1.

17. The method of claim 13, wherein the fiber tow is selected from the group consisting of organic fibers and inorganic fibers.

18. The method of claim 17, wherein the organic fibers are selected from the group consisting of polymeric fibers and natural fibers.

19. The method of claim 17, wherein the inorganic fibers are selected from the group consisting of glass fibers, carbon fibers, silicon fibers, silicon nitride fibers, alumina fibers, metallic fibers, steel tungsten fibers and boron fibers.

20. The method of claim 13, wherein the fiber tow comprises carbon fibers.

21. A method for manufacturing an apparatus for splitting a fiber tow, comprising:

fabricating a spreading bar comprising a crown and fabricating a circular or oval-shaped splitter bar comprising grooves around the circumference of the splitter bar, wherein each of the grooves do not circumscribe the complete circumference of the splitter bar and wherein a radius of the crown is R, a width of the crown is W and a ratio R/W is about 50/1 to 3/1.

22. The method of claim 21, further comprising:

installing a feed and creel device, installing a drying oven and installing a winder.

23. A split fiber strand formed by splitting a fiber tow, the split fiber strand having a degree of separation of about 90% or more.

24. A split fiber strand of claim 23, wherein the split strand comprises carbon fibers.

* * * * *